US005930843A

United States Patent [19]

Kelly

[11] Patent Number: 5,930,843

[45] Date of Patent: Aug. 3, 1999

[54] HELMET AND SHOULDER HARNESS ASSEMBLY PROVIDING CERVICAL SPINE PROTECTION

[76] Inventor: James M. Kelly, 2423 Girard Turn, Kankakee, Ill. 60901

[21] Appl. No.: 09/033,168

[22] Filed: Mar. 2, 1998

Related U.S. Application Data

[60] Provisional application No. 60/039,780, Mar. 4, 1997.

[51] Int. Cl.[6] ..... A41D 13/00; A42B 3/00

[52] U.S. Cl. ..... 2/468; 2/461; 2/421; 2/425

[58] Field of Search ..... 2/459, 461, 410, 2/411, 421, 425, 468, 422, 455

[56] References Cited

U.S. PATENT DOCUMENTS

| | | | |
|---|---|---|---|
| D. 354,375 | 1/1995 | Lechner | D29/107 |
| D. 355,731 | 2/1995 | Gingras | D29/102 |
| D. 361,867 | 8/1995 | Taniuchi | D29/102 |
| 3,134,106 | 5/1964 | Shaffer et al. | 2/468 |
| 3,174,155 | 3/1965 | Pitman | 2/425 |
| 3,925,822 | 12/1975 | Sawyer | 2/3 |
| 4,638,510 | 1/1987 | Hubbard | 2/6 |
| 4,825,476 | 5/1989 | Andrews | 2/421 |
| 5,287,562 | 2/1994 | Rush, III | 2/413 |
| 5,353,437 | 10/1994 | Field et al. | 2/468 |
| 5,444,870 | 8/1995 | Pinsen | 2/2 |
| 5,493,736 | 2/1996 | Allison | 2/416 |
| 5,517,699 | 5/1996 | Abraham, II | 2/425 |
| 5,546,601 | 8/1996 | Abeyta | 2/461 |

FOREIGN PATENT DOCUMENTS

| | | |
|---|---|---|
| 1098374 | 1/1968 | United Kingdom . |
| 1348239 | 3/1974 | United Kingdom . |
| 1519771 | 8/1978 | United Kingdom . |

*Primary Examiner*—Michael A. Neas
*Attorney, Agent, or Firm*—Richard C. Litman

[57] ABSTRACT

A cervical spine protective helmet and shoulder harness assembly. The helmet and shoulder-harness assembly includes a yoke or shoulder pad having a central opening for the wearer's head to pass therethrough. A protective helmet is pivotally supported over the central opening. Arcuate tracks allow the head of the wearer to be turned from side to side. Stops within the pivoting joints supporting the helmet limit neck flexion and extension. Stops at the ends of these tracks limit neck torsion. Neck compression is limited by the rigidity of the uprights supporting the helmet.

18 Claims, 7 Drawing Sheets

HELMET AND SHOULDER HARNESS ASSEMBLY PROVIDING CERVICAL SPINE PROTECTION

CROSS-REFERENCE TO RELATED APPLICATION

This application claims the benefit of U.S. Provisional Patent Application Ser. No. 60/039,780, filed Mar. 4, 1997.

BACKGROUND OF THE INVENTION

1. Field of the Invention

The present invention relates to a protective apparel for protecting the head and cervical spine.

2. Description of Related Art

Serious, often devastating neurologic injuries result from head trauma and cervical spine trauma. Traditional helmets offer some degree of protection against head injury and the potential for brain injury, but offer no protection against cervical spine injury, and the potential for cervical spinal cord injury. Cervical spine injury is usually the result of one of several distinct circumstances. First abrupt forceful axial loading is one common cause of cervical spine injury; an example of this would be the typical shallow water diving accident. Another common cause of cervical spine injury is excessive flexion or extension of the neck; an example of the latter would be the extreme extension associated with a severe whiplash. A third common cause of cervical spine injury is excessive cervical rotation. Such a circumstance is encountered for example, when a football player's face mask is grabbed by an opposing player.

The above may cause cervical spine compression fractures, fracture dislocations, facet joint dislocations, and/or cervical disc herniations. These frequently result in cervical spinal chord injury with some degree of attendant quadraparesis or quadriplegia. Protective apparel attempting to provide some degree of cervical spine protection have been proposed in the prior art; however, none have achieved a level of functionality that would allow their widespread acceptance.

U.S. Pat. No. Des. 354,375, issued to Robert R. Lechner on Jan. 10, 1995, shows a cervically non-involved facial-cranial protective helmet. The lower rim of the helmet of Lechner is cut away at the back of the head to provide clearance for tilting the head back without interference from the helmet. The helmet of Lechner provides no cervical spine protection.

U.S. Pat. No. Des. 355,731, issued to Fabien Gingras on Feb. 21, 1995, shows a safety helmet with facial protection. The helmet of Gingras provides no cervical spine protection.

U.S. Pat. No. Des. 361,867, issued to Fujio Taniuchi on Aug. 29, 1995, shows a safety helmet with a pivotable facial protection shield. The helmet of Taniuchi provides no cervical spine protection.

U.S. Pat. No. 3,925,822, issued to John H. Sawyer on Dec. 16, 1975, shows a safety harness for securely holding a helmet on the head of a person. The safety harness of Sawyer provides no protection against abrupt, forceful axial loading of the cervical spine.

U.S. Pat. No. 4,638,510, issued to Robert P. Hubbard on Jan. 27, 1987, shows a neck protection device having a yoke and a high collar which surrounds a helmet. Straps extend between the rim of the collar and the helmet to limit flexion and extension of the cervical spine. The neck protection device of Hubbard severely restricts the turning of the head from side to side while providing no protection in case of abrupt, forceful axial loading of the cervical spine.

U.S. Pat. No. 4,825,476, issued to Donald L. Andrews on May 2, 1989, shows an articulated head, neck, and shoulder protection device. The protection device of Andrews includes an annular cradle which is rotatably mounted to a shoulder protector. The annular cradle has two vertical projections that rotatably support a helmet. The vertical projections fit into depressions on either side of the helmet. The depressions define the limits of the rotation of the helmet and thus the limits of the flexion and extension of the neck. So far as can be determined, the Andrews device makes no provision for preventing the excessive torsion of the cervical spine. Further, Andrews does not show the flexion and extension limiting structure of the present invention.

U.S. Pat. No. 5,287,562, issued to Gus A. Rush, III on Feb. 22, 1994, shows an athletic helmet with an inflatable bag at its lower rim. The bag inflates upon axial impact to protect the cervical spine in case of abrupt, forceful axial loading. The Rush device does not protect the cervical spine against excessive flexion, extension, or torsion.

U.S. Pat. No. 5,444,870, issued to David Pinsen on Aug. 29, 1995, shows a football helmet having neck protection. The neck protection includes an inner and an outer guide in the shape of sphere portions. A movable inner element has upwardly extending members which connect to a helmet. The Pinsen device does not use the same type of structure for movably joining the helmet to the shoulder pad as is used in the present invention.

U.S. Pat. No. 5,493,736, issued to Norman E. Allison on Feb. 27, 1996, shows an athletic helmet having a rigid collar projecting from the helmet and extending around the helmet's base. The collar is positioned some distance above two uprights extending from the shoulder pads. The Allison device does not protect the neck from excessive flexion or torsion.

U.S. Pat. No. 5,517,699, issued to George E. Abraham, II on May 21, 1996, shows a helmet accessory for protecting a wearer from cervical spine injuries. The accessory forms a cage around the helmet which either limits movements of the head or distributes impacts to the shoulder pads rather than allowing the impacts to be imparted to the helmet. The Abraham device does not use the same type of structure for movably joining the helmet to the shoulder pad as is used in the present invention.

U.K. Patent Document Number 1 348 239, by Ayub Khan Ommaya et al. published on Mar. 13, 1974, shows a device for reducing movement of the head and neck. The device includes an inflatable cervical collar. The Ommaya et al. device does not have sufficient rigidity to adequately prevent excessive flexion, extension, compression, or torsion of the neck. Further, the Ommaya et al. device does not use the same type of structure for movably joining the helmet to the shoulder pad as is used in the present invention.

U.K. Patent Document Number 1,098,374, by The Minister of Technology published on Jan. 10, 1968, shows a pressure helmet with a pressure seal around the neck. The helmet of U.K. Document '374 does not provide protection for the neck from excessive flexion, extension, compression, or torsion.

U.K. Patent Document Number 1 519 771, by Peter William Bothwell published on Aug. 2, 1978, shows a head and upper torso protector having a rigid shell and inflatable bags on the outside of the shell. The Bothwell device does not use the same type of structure for movably joining the helmet to the shoulder pad as is used in the present invention.

None of the above inventions and patents, taken either singularly or in combination, is seen to describe the instant invention as claimed.

SUMMARY OF THE INVENTION

The present invention is directed to a cervical spine protective helmet and shoulder harness assembly. The helmet and shoulder harness assembly includes a shoulder protector adjustable to chest size of a wearer, the shoulder protector having a central opening for the wearer's head to pass therethrough. A protective helmet is pivotally supported over the central opening. A helmet support assembly is provided to each side of the central opening, wherein arms engage arcuate tracks which allow a wearer's head to rotate with the helmet. Stops at the ends of these tracks limit neck torsion. Stops within pivoting joints of the helmet support assembly limit neck flexion and extension. Neck compression is limited by the rigidity of the uprights supporting the helmet.

Accordingly, it is a principal object of the invention to provide a helmet and shoulder harness assembly that protects the cervical spine.

It is another object of the invention to provide a helmet and shoulder harness assembly which limits neck flexion, extension, compression, and torsion.

It is a further object of the invention to provide a helmet and shoulder harness assembly that also affords some protection to the wearer's shoulders.

Still another object of the invention is to provide a helmet and shoulder harness assembly that protects the cervical spine without unduly restricting the wearer's freedom of head movement.

It is an object of the invention to provide improved elements and arrangements thereof in a protective helmet and shoulder harness assembly for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
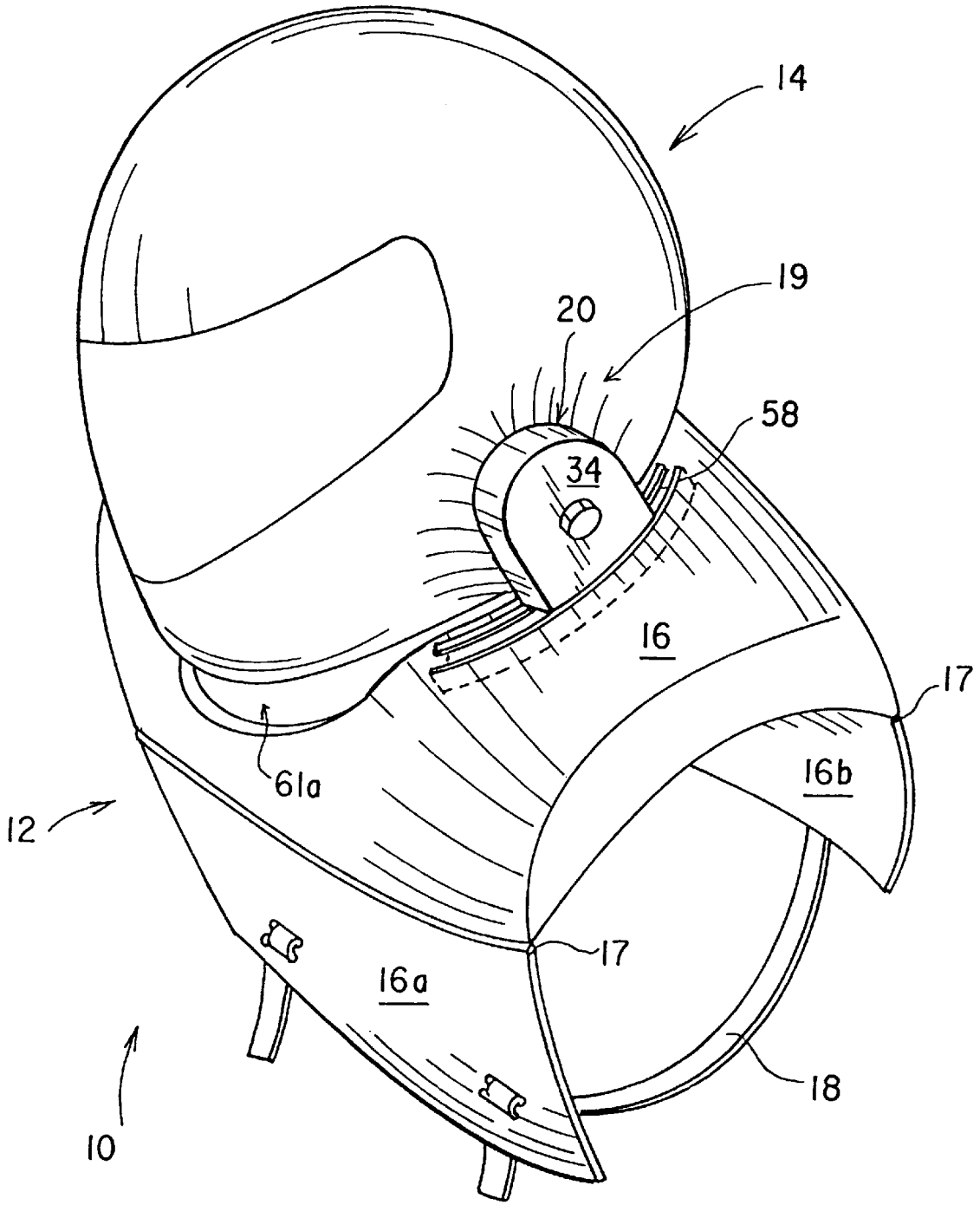
FIG. 1 is a perspective view of a first embodiment of the helmet and shoulder harness assembly according to the present invention.
Figure 2:
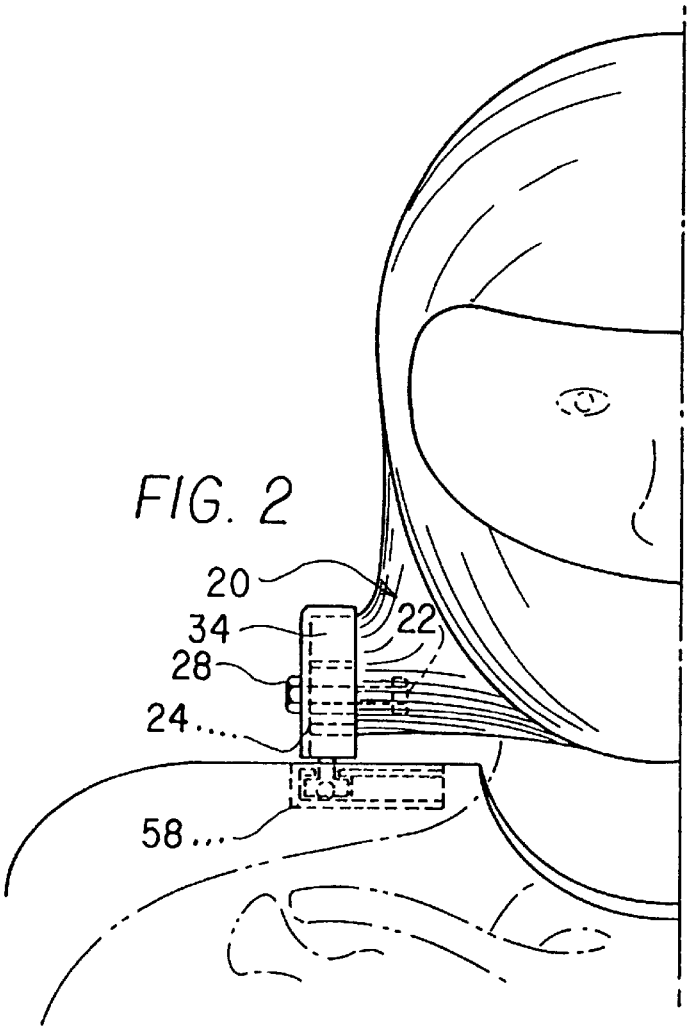
FIG. 2 is a partial, front environmental view of a first embodiment of the helmet and shoulder harness assembly according to the present invention.
Figure 3:
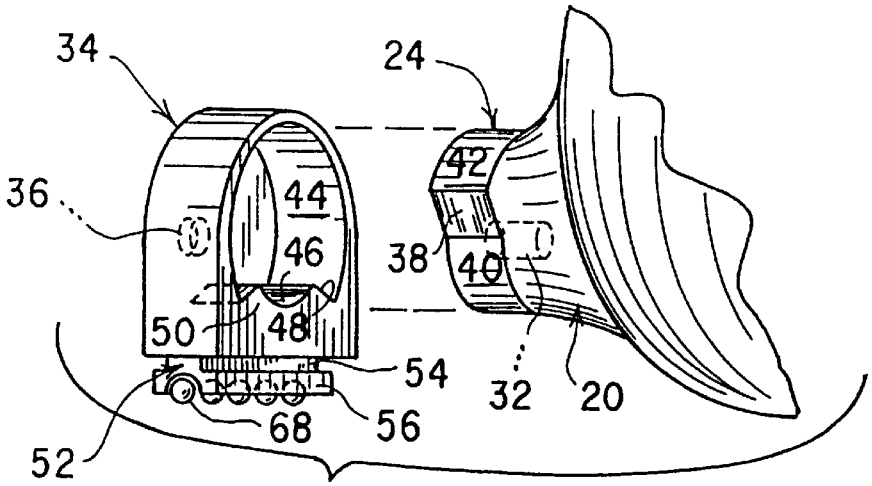
FIG. 3 is a fragmented and partially exploded perspective view of a first embodiment of the helmet support assembly according to the present invention.

Referring to FIGS. 1, 2 and 3, the present invention is directed to a helmet and shoulder harness assembly 10 designed to provide cervical spine protection without unduly interfering with the wearer's freedom of head movement. The helmet and shoulder harness assembly includes a yoke or shoulder harness assembly 12 and a helmet 14.

The helmet 14 is dimensioned and configured to allow a person's head to ergonomically and closely fit inside the helmet. The helmet 14 is formed by a hard impact resistant shell made from a hard plastic or lightweight high strength composite material. The helmet 14 can optionally be of the type having mandibular protection. The helmet 14 has interior padding which can be made of foam rubber, styrofoam, gel-filled pouches, air-filled pouches, or any combination thereof. The pouches delineated above could be quilt-like in nature. Each of these features are intended to retain the cranium of a wearer as closely and as comfortably possible, and may be made in any manner familiar to an individual skilled in the art of protective helmets for use with high-speed motor vehicles.

The shoulder harness assembly 12 includes a shoulder protector 16 in the form of a shell made of a hard plastic or lightweight high strength composite material which may be similar to the material employed for fabricating the helmet 14. The underside of the shoulder protector 16 is padded with any of the padding materials listed above for the helmet 14. A pair of straps 18 are used to secure the shoulder protector 16 to the wearer's shoulders.

The shoulder protector 16 is provided with features to allow adjustment of the protector to variously sized chests and shoulders. The shoulder protector 16 may be made as a unitary piece ergonomically fitted to the upper body in various sizes. The shoulder protector's material characteristics should include strength, impact resistance and flexibility, such that the panels 16*a* and 16*b* may be flexed by tensioning the straps 18 to closely conform to the surfaces of the upper body. In the alternative, as shown in FIG. 1, a bipartite, shoulder protector 16 may include a hinge 17 connecting each panel 16*a* and 16*b* to the main body of the protector 16. The hinge 17 may be selected from suitable hinges known in the prior art which provide resistance to changes in position, in order to retain a position once it has been established.

Depending from either side of the helmet 14 are a pair of helmet support assemblies 19. These include arms 20, which may be functionally designed to consider aerodynamic and shear resistance characteristics, e.g. by limiting drag creating protrusions from the side of the helmet. Thus, the helmet support assemblies 19 and arms 20 may take numerous shapes, ranging from a casing rigidly attached to the helmet containing the pivoting mechanism described according to the first embodiment, to planar arms extending downward from the helmet for attachment of the remaining parts of the helmet support assembly (not shown). The embodiments of the present invention are intended as exemplary of the functional principles common to each embodiment.

In the first embodiment, each arm 20 is rigidly fixed relative to an insert 24 such that the arms 20 and their respective inserts 24 rotate as a unit (best appreciated from FIG. 3). In the illustrated example, each insert 24 has a round receiving hole 32 for securely receiving a bolt 28 or other fastener. Each insert 24 is rotatably supported within a receptacle 34. Each receptacle 34 has a through hole 36 to allow a threaded end of the bolt 28 to pass therethrough. Other engineering methods and suitable structures to create a securely fixed pivot axis for inseparably connecting the receptacle 34 and the insert 24 may be used. A nut 22 may be permanently embedded in the arm 20 to hold together each assembly including an arm 20, an insert 24, and a receptacle 34.

Each of the inserts 24 has a pair of radial surfaces 38 extending radially from the central longitudinal axis of the hole 32. The surfaces 38 extend from a first arcuate surface 40 to a second arcuate surface 42. The radius of the arc defining the surface 40 is smaller than the radius of the arc defining the surface 42. Both arcuate surfaces 40 and 42 are concentric with the hole 32. The cavity defined by the receptacle 34 has a peripheral wall defined by a first arcuate surface 44, a second arcuate surface 46, and a pair of radial surfaces 48. The radius of the arc defining the surface 44 is larger than the radius of the arc defining the surface 46. The surfaces 48 extend from the arcuate surface 44 to the arcuate surface 46. The portion of the wall of the receptacle 34 delineated by the two surfaces 48 and the surface 46, forms a projection 50. The projection 50 fits into the space between the surfaces 38 and adjacent the surface 40, when the insert 24 and the receptacle 34 are assembled together. Rotation of the insert 24 relative to the receptacle 34 is stopped when either of the surfaces 38 abuts the projection 50. Thus, the difference between the angular displacement between the surfaces 38 and the angular displacement between the surfaces 48, defines the limits of the flexion and extension of the wearer's neck. With these limits chosen such that the wearer's neck can safely flex or extend between them, the helmet and shoulder harness assembly 10 will effectively reduce the probability of neck injury resulting from excessive flexion or extension of the neck. To accommodate normal flexion and extension, the shoulder protector 16 has a central opening 60 widened by cutouts 61*a* and 61*b* anteriorly and posteriorly to allow the wearer's head to nod and prevent contact of the helmet 14 with the shoulder protector 16.

Projecting from the bottom of the receptacles 34 are bases 52. The bases 52 project from the receptacles 34 in a direction perpendicular to the axis of rotation of the insert 24. Each base 52 has a narrow portion 54 and a wide portion 56. The wide portions 56 of each base 52 fit into respective tracks 58. The bases and receptacles 34 should provide a broad surface for contact with the track to provide additional stability against anterior and posterior stresses.

Figure 8:
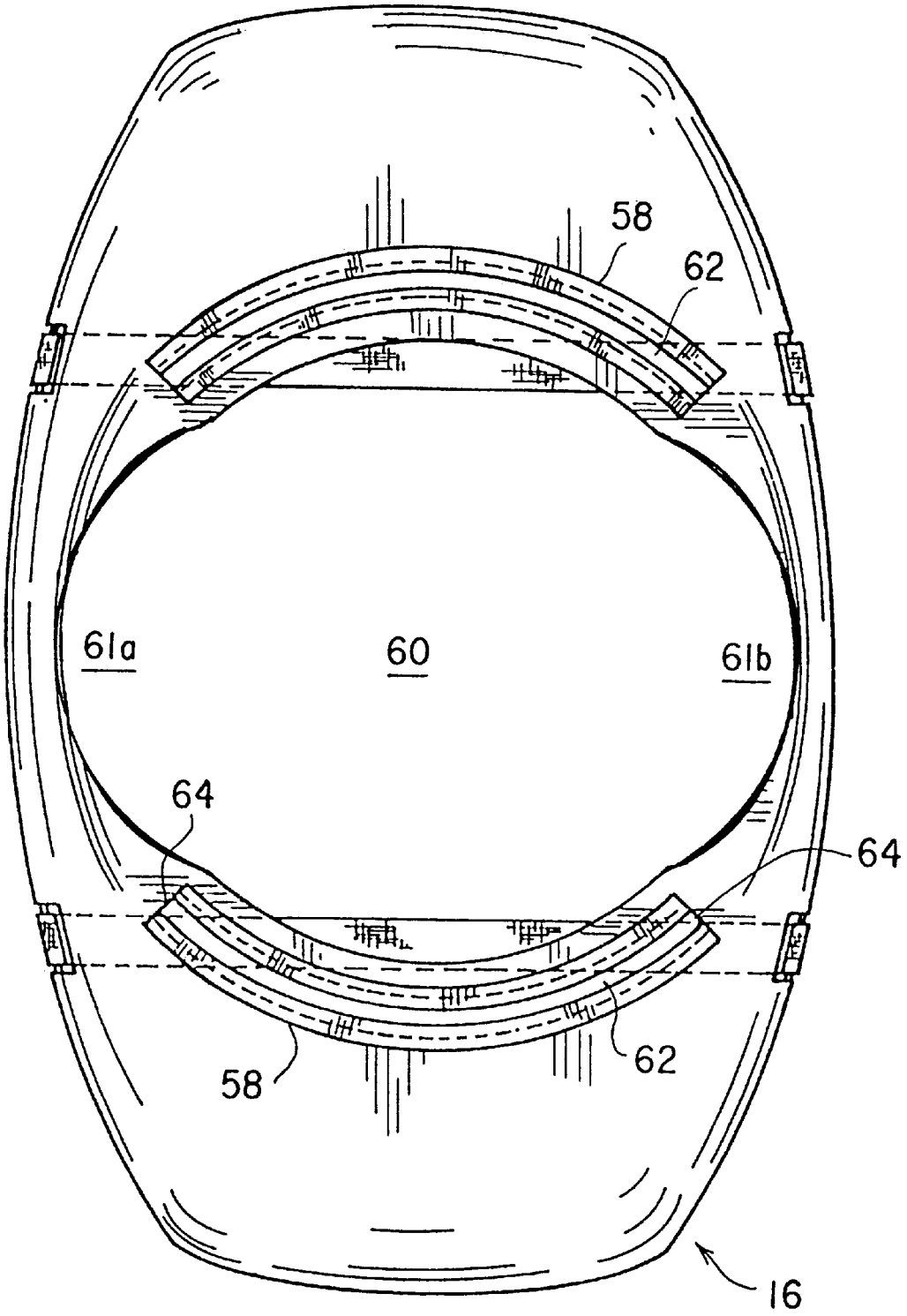
FIG. 8 is a top plan view of the shoulder harness assembly according to the present invention.

As can be best appreciated from FIG. 8, the shoulder protector 16 has a central opening 60 to allow the wearer's head to pass through the shoulder protector 16. Each track 58 is positioned on either side of the opening 60. The tracks 58 are rigidly fixed to the shoulder protector 16 and are preferably recessed to limit aerodynamic resistance and possible damage to the tracks. Each track 58 is C-shaped in cross section and has a top opening 62 running along the length of the track 58. The openings 62 allow the narrow portions 54 of the bases 52 to pass out of the tracks 58. The tracks 58 are arcuate such that the bases 52 can slide along the tracks 58 as the helmet 14 is rotated about its central vertical axis. Thus the arcuate shape of the tracks 58 allows the wearer to turn his or her head from side to side.

Figure 9:
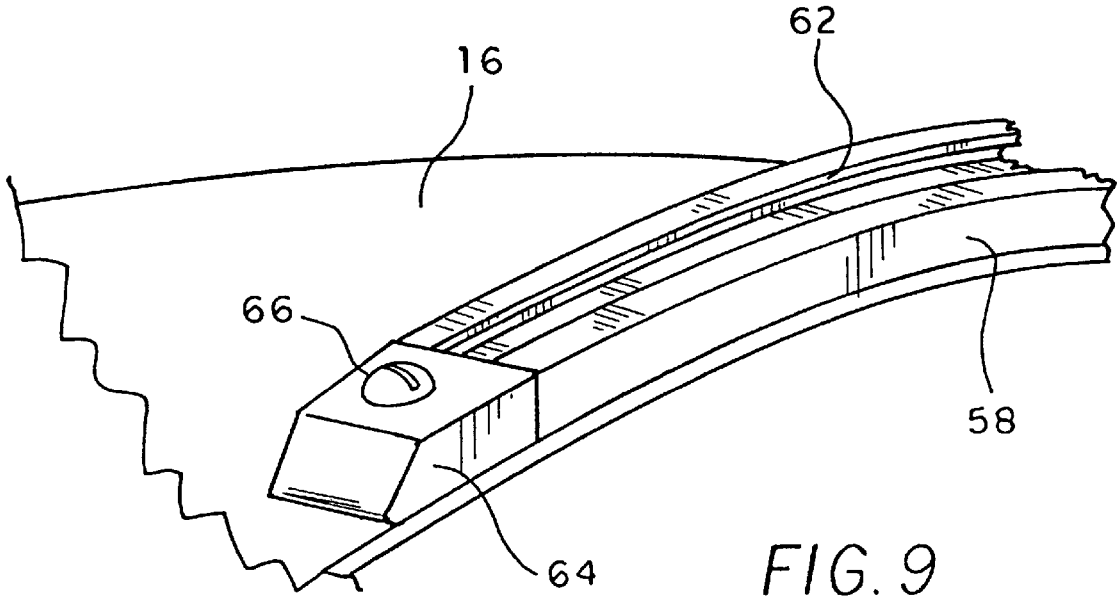
FIG. 9 is a detail, perspective view of mounting track on the shoulder protector of the invention.

Referring to FIG. 9, end caps 64 are fixed at the ends of the tracks 58 to limit the side to side rotation of the helmet 14. Such end caps 64 may be recessed into channel provided within the shoulder protector 16 and serve as a means of installing the track into the channel. In the illustrated example, screws 66 (only one shown, FIG. 9) are used to removably secure the end caps 64 to the shoulder protector 16, at the ends of the tracks 58. This feature reduces the probability of neck injury from excessive torsion of the wearer's head.

The openings 62 of the tracks 58 being narrower than the wide portions 56 of the bases 52, the bases 52 and thus the helmet 14 are prevented from vertical movement relative to the shoulder protector 16. Blows or impacts that would otherwise cause compression of the cervical spine, are distributed to the shoulders because the helmet 14 cannot move vertically closer to the shoulder protector 16. Thus the probability of cervical spine injuries from forceful axial or compressive loading is reduced.

Referring again to FIG. 3, optional ball bearings 68 can be provided in the wide portions 56 of the bases 52 to reduce frictional resistance to the sliding movement of the bases 52 along the tracks 58. The shape of the cross section of the tracks 58 will have to be modified accordingly to provide a race (hidden) for the ball bearings 68.

Figure 4:
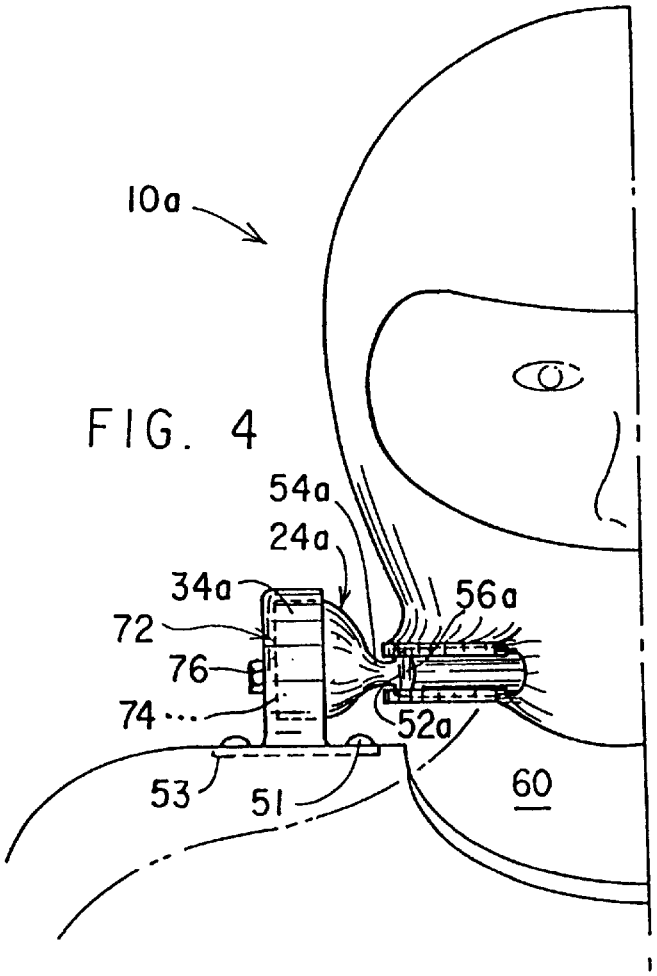
FIG. 4 is a partial, front environmental view of a second embodiment of the helmet and shoulder harness assembly according to the present invention.
Figure 5:
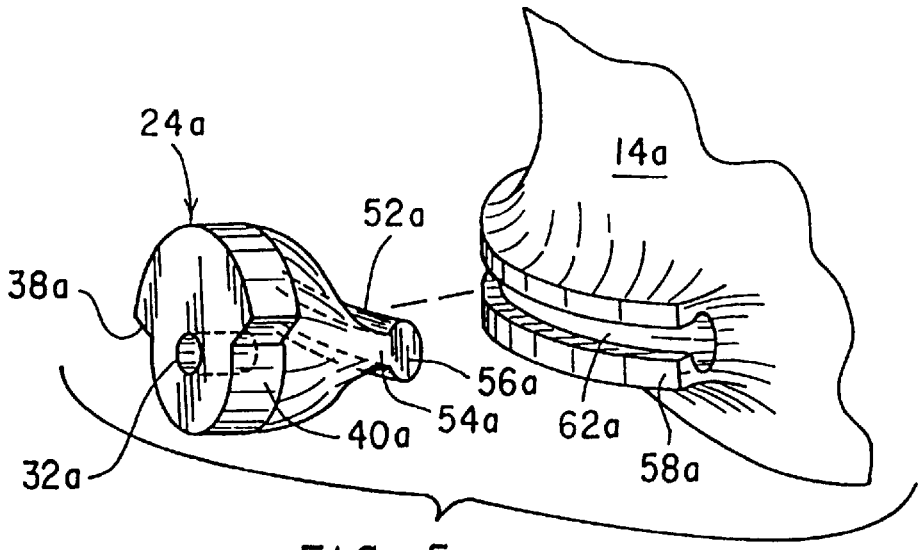
FIG. 5 is a fragmented and partially exploded perspective view of the second embodiment of the helmet support assembly according to the present invention.

Referring to FIGS. 4 and 5, a second embodiment 10*a* of the helmet and shoulder harness assembly of the present invention can be seen. In the embodiment 10*a*, the shoulder protector has two rigid cases 72 projecting vertically upward from either side of the opening 60. Such cases 72 are internally configured to receive an insert 24*a* identically to the assembly comprising receptacle 34 and insert 24 of embodiment 10. Inserts 24*a*, similar to inserts 24, are provided to be received by cases 72. As with the inserts 24, the inserts 24*a* have a reduced radius on one side thereof forming a reduced radius arcuate surface 40*a* extending between radially extending surfaces 38*a*. A receptacle portion 34*a* has a cavity 74 for receiving the insert 24*a* in the same manner in which insert 24 is received by receptacle 34. A projection (hidden) is provided on the interior of cavity 74. The projection fits into the space between the surfaces 38*a* and adjacent the surface 40*a*, when the insert 24*a* and the receptacle 34*a* are assembled together. Rotation of the insert 24*a* relative to the receptacle 34*a* is stopped when either of the surfaces 38*a* abuts the projection 50*a*. Bolt 76 and a nut embedded within receiving hole 32*a* secures the insert 24*a* and the receptacle 34*a* together.

Projecting from a location near the bottom of the receptacle portion 34*a* are flanges 53 for attachment of the receptacle portion to the shoulder protector 16. However, unlike receptacle 34, the flanges 53 are rigidly attached to the shoulder protector 16, in lieu of track 58. Fasteners 51 may be used to secure the receptacle flanges 53 to shoulder protector 16. However, in the preferred embodiment, the receptacle 34*a* is integrally molded into the shoulder protector 16 to minimize edges and structural joints or weaknesses, with further considerations toward improving aerodynamic and shear stress characteristics of the embodiment.

From each insert 24*a* in a direction parallel to the axis of rotation of the receptacle 34*a* extends a base 52*a*. Each base 52*a* has a narrow portion 54*a* and a wide portion 56*a*. The wide portions 56*a* of each base 52*a* fit into respective tracks 58*a*, which to allow rotation of the head, are in this embodiment attached integrally to the helmet 14*a*. A track 58*a* is fixedly attached to either side of the helmet 14*a* such that the track is roughly at the level of the base of the skull of the wearer. Each track 58*a* is C-shaped in cross section and has an opening 62*a* running along the length of the track 58. The openings 62*a* allow the narrow portions 54*a* of the bases 52*a* to pass out of the tracks 58*a*. The tracks 58*a* are arcuate such that the tracks 58*a* can slidably move relative to the bases 52*a*, while the wide portions 56*a* remain inside the tracks 58*a*, as the helmet 14*a* is rotated about its central vertical axis. Thus the arcuate shape of the tracks 58*a* allows the wearer to turn his or her head from side to side. As before, the tracks 58*a* are provided with similar end caps 64 to limit the side to side rotation of the helmet 14*a*. The limited head rotation reduces the probability of neck injury from excessive torsion of the wearer's head.

Because the tracks 58*a* surround the wide portions 56*a* of the bases 52*a* such that there can be no vertical movement of the tracks 58*a* relative to the receptacles 34*a*, the helmet 14*a* is prevented from vertical movement relative to the shoulder protector 16. Blows or impacts that would otherwise cause compression of the cervical spine, are distributed to the shoulders because, as in the embodiment 10, the helmet 14*a* cannot move vertically closer to the shoulder protector 16. Thus the probability of cervical spine injuries from forceful axial or compressive loading is reduced. Also because the projection 50*a* limits extension and flexion of the wearer's neck, the probability of neck injury resulting from excessive flexion or extension of the neck is reduced.

Figure 6:
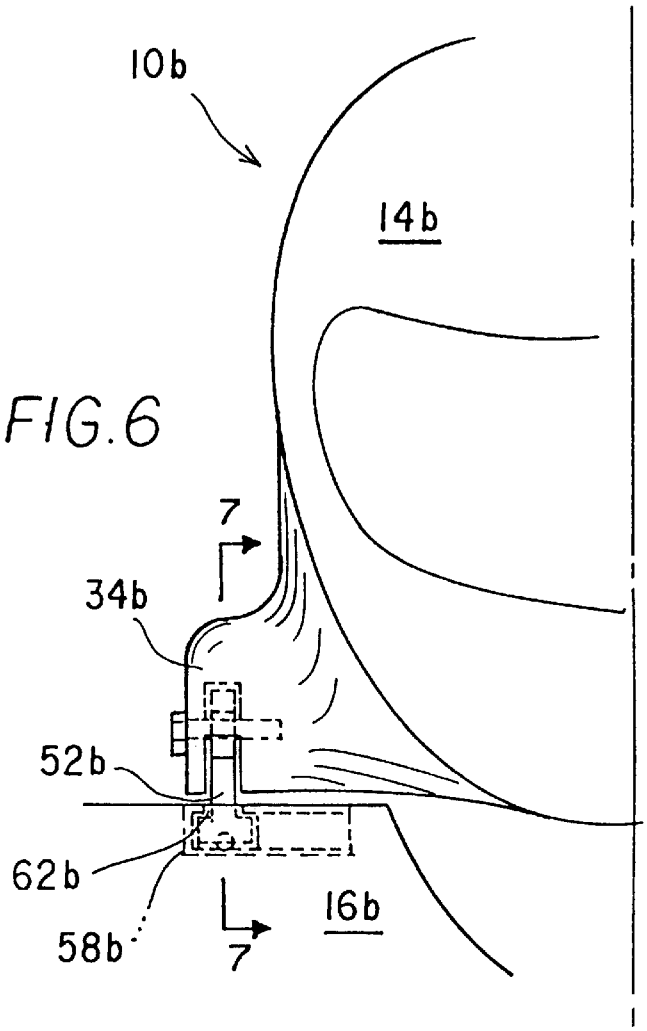
FIG. 6 is a partial, front elevational view of a third embodiment of the helmet and shoulder harness assembly according to the present invention.
Figure 7:
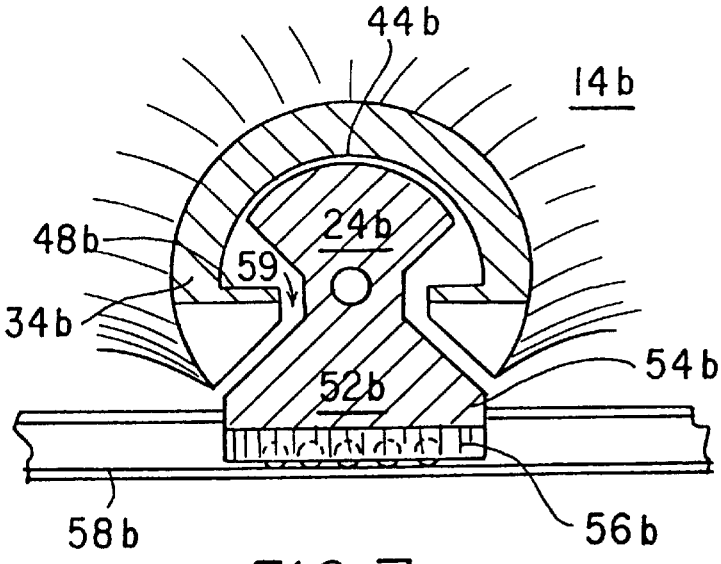
FIG. 7 is a sectional view of the helmet support assembly according to the third embodiment of the present invention as shown along line 7—7 of FIG. 6.

Referring to FIG. 6 and FIG. 7, a third embodiment 10*b* of the helmet and shoulder harness assembly embodying the principles of the present invention can be seen. The embodiment 10*b* is substantially identical to the first embodiment 10, with the below notable differences. In the embodiment 10*b* the receptacles 34*b* are rigidly fixed to the helmet 14*b* to define an enclosed, rather than open, cavity between surfaces 44*b*. Instead of protrusion 50, a mouth 59 is provided. An insert 24*b* is inserted into receptacle 34*b* through mouth 59 and pivotally seats in the same manner as the prior embodiments to prevent excessive anterior/posterior flexion.

The insert 24*b* is comparable to each insert 24*a*, except that base 52*b* extends in a direction perpendicular to the axis of rotation of the receptacle 34*b*. Each base 52*b* has a narrow portion 54*b* and a wide portion 56*b*. The wide portions 56*b* of each base 52*b* fit into respective tracks 58*b*, which to allow rotation of the head, are in this embodiment attached integrally to shoulder protector 16*b*. A track 58*b* is fixedly attached to either side of the helmet 14*b* such that the track is roughly at the level of the base of the skull of the wearer. Each track 58*b* is C-shaped in cross section and has an opening 62*b* running along the length of the track 58*b*. The openings 62*b* allow the narrow portions 54*b* of the bases 52*b* to pass out of the tracks 58*b*. The tracks 58*b* are arcuate such that the tracks 58*b* can slidably move relative to the bases 52*b*, while the wide portions 56*b* remain inside the tracks 58*b*, as the helmet 14*b* is rotated about its central vertical axis. Thus the arcuate shape of the tracks 58*b* allows the wearer to turn his or her head from side to side. As before, the tracks 58*b* are provided with similar end caps 64 to limit the side to side rotation of the helmet 14*b*. The limited head rotation reduces the probability of neck injury from excessive torsion of the wearer's head.

Figure 10:
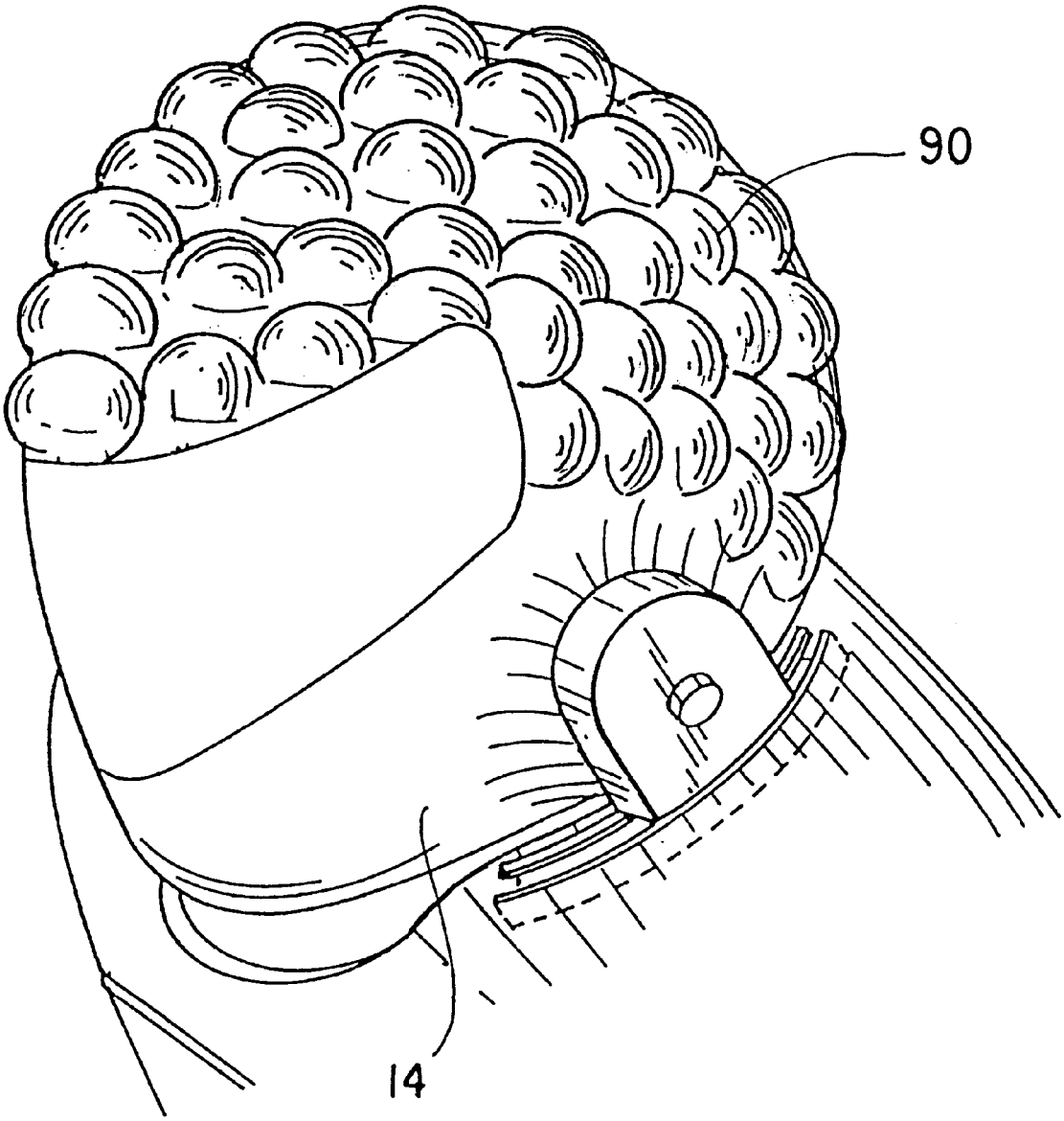
FIG. 10 is a perspective view of the helmet with shock absorbing padding on the outer surface.

Referring to another embodiment of the present invention shown in FIG. 10, an embodiment substantially identical to the first embodiment 10 except for having cushioning material 90 provided on the exterior of the helmet 14 can be seen. The cushioning material 80 can be made of foam rubber, styrofoam, gel-filled pouches, air-filled pouches, or any combination thereof. The external cushioning can also be applied to any of the other embodiments described above. The pouches delineated above are quilt-like in nature.

Although in the illustrated examples the helmet resembles a motor cycle helmet, any type of helmet, including a football helmet, can be used as part of the helmet and shoulder harness assembly of the present invention. The helmet and shoulder harness assembly of the present invention is suitable, with minimal modifications, for use in any activity that entails risk of head and/or cervical spine injury. Such activities include, but are not limited to, contact sports, such as football, and non-contact sports, such as motorcycling, bicycling, and equestrian sports, particularly show jumping, polo, and steeplechase events.

The assembly including the insert 24 or 24*a*, and the receptacle 34 or 34*a* is referred to herein as the cylindrical flexion/extension joint. The arms 20, 20*a*, and the posts 72 can be made of high strength, light weight metal such as titanium or stainless steel, or a light weight high strength composite material. The cylindrical flexion/extension joints would be made of similar material. In the embodiments, the cylindrical flexion/extension joints are preferably positioned when worn at the level of the most flexible portion of the cervical spine, namely $C_5$ through $C_7$. The straps 18 can be secured with any suitable fastening means including buckles, hook-and-loop fasteners, spring loaded clips, or snap fasteners.

It is to be understood that the present invention is not limited to the embodiments described above, but encompasses any and all embodiments within the scope of the following claims.

I claim:

1. A helmet and shoulder harness assembly for providing head and cervical spine protection, said helmet and shoulder harness assembly comprising:

a shoulder protector having a central opening for a wearer's head to pass therethrough;

a helmet dimensioned and configured to protect the wearer's head, said helmet having an inner surface and an outer surface;

a pair of arms extending from either side of said helmet;

a pair of arcuate tracks fixedly attached to said shoulder protector on either side of said central opening;

a pair of bases each slidably supported by a respective one of said pair of arcuate tracks, each of said pair of bases having a bottom surface being confined to limits of movement defined by said respective one of said pair of arcuate tracks; and a pair of flexion/extension limiting joints each connecting a respective one of said pair of arms to a respective one of said pair of bases, whereby a wearer's cervical spine is protected from excessive flexion, extension, torsion, and compression.

2. The helmet and shoulder harness assembly of claim 1, wherein the helmet is constructed from high strength composite material and further comprises a cushion on the inner surface of said helmet.

3. The helmet and shoulder harness assembly of claim 2, wherein the helmet further comprises a cushion on the outer surface of said helmet.

4. The helmet and shoulder harness assembly of claim 3, wherein said shoulder harness is constructed from lightweight, high strength composite material and further comprises padding attached to the underside of said shoulder harness; and a pair of straps attached to either side of said shoulder harness for securing said shoulder harness to the wearer's shoulders.

5. The helmet and shoulder harness assembly of claim 4, wherein said bases are provided with ball bearings on said bottom surface.

6. The helmet and shoulder harness assembly of claim 5, wherein said flexion/extension limiting joint comprises:

a receptacle integrally connected with one of said bases, said receptacle having a through hole therein for receiving a fastener;

said receptacle defining a cavity having an inner peripheral wall, wherein said wall is defined by a first arcuate surface, a second arcuate surface, and a pair of radially extending surfaces therebetween;

an insert integrally connected with one of said arms, and inserted within said receptacle, said insert having a round receiving hole aligning with said through hole of said receptacle and for receiving said fastener;

a pair of contact surfaces extending radially from the central longitudinal axis of said hole;

said surfaces extending from a first arcuate surface to a second, larger arcuate surface forming an arc therebetween; wherein, said arcuate surfaces of said insert are concentric with said arcuate surface of said receptacle; whereby, upon rotation of said insert within said receptacle said contact surface of said insert abuts said radial surface of said receptacle, thereby limiting the flexion and extension of the wearer's neck.

7. A helmet and shoulder harness assembly for providing head and cervical spine protection, said helmet and shoulder harness assembly comprising:

a shoulder protector having a central opening for a wearer's head to pass therethrough;

a helmet dimensioned and configured to protect the wearer's head, said helmet having a lower rim and an inner surface and an outer surface;

a pair of arms extending from either side of said central opening;

a pair of arcuate tracks fixedly attached to said helmet proximate said lower rim;

a pair of bases each slidably supported by a respective one of said pair of arcuate tracks, each of said pair of bases being confined to limits of movement defined by said respective one of said pair of arcuate tracks; and a pair of flexion/extension limiting joints each connecting a respective one of said pair of arms to a respective one of said pair of bases, whereby a wearer's cervical spine is protected from excessive flexion, extension, torsion, and compression.

8. The helmet and shoulder harness assembly of claim 7, wherein the helmet is constructed from high strength composite material and further comprises a cushion on the inside surface of said helmet.

9. The helmet and shoulder harness assembly of claim 8, wherein the helmet further comprises a cushion on the outer surface of said helmet.

10. The helmet and shoulder harness assembly of claim 9, wherein said shoulder harness is constructed from lightweight, high strength composite material and further comprises:

padding attached to the underside of said shoulder harness; and a pair of straps attached to either side of said shoulder harness for securing said shoulder harness to the wearer's shoulders.

11. The helmet and shoulder harness assembly of claim 10, wherein said bases are provided with ball bearings on said bottom surface.

12. The helmet and shoulder harness assembly of claim 11, wherein said flexion/extension limiting joint comprises:

a receptacle integrally connected with one of said arms, said receptacle having a through hole therein for receiving a fastener;

said receptacle defining a cavity having an inner peripheral wall, wherein said wall is defined by a first arcuate surface, a second arcuate surface, and a pair of radially extending surfaces therebetween;

an insert integrally connected with one of said bases, and inserted within said receptacle, said insert having a round receiving hole aligning with said through hole of said receptacle and for receiving said fastener;

a pair of contact surfaces extending radially from the central longitudinal axis of said hole;

said surfaces extend from a first arcuate surface to a second, larger arcuate surface forming an arc therebetween; wherein, said arcuate surfaces of said insert are concentric with said arcuate surface of said receptacle; whereby, upon rotation of said insert within said receptacle said contact surface of said insert abuts said radial surface of said receptacle, thereby limiting the flexion and extension of the wearer's neck.

13. A helmet and shoulder harness assembly for providing head and cervical spine protection, said helmet and shoulder harness assembly comprising:

a shoulder protector having a central opening for a wearer's head to pass therethrough;

a helmet dimensioned and configured to protect the wearer's head, said helmet having a lower rim and an inner surface and an outer surface;

a pair of arcuate tracks fixedly attached to said helmet proximate said lower rim;

a pair of arms having a base, said base of each of said pair of arms being slidably supported by a respective one of said pair of arcuate tracks, said base of each of said pair of arms being confined to limits of movement defined by said respective one of said pair of arcuate tracks, each of said pair of arms extending downward from said respective one of said pair of arcuate tracks; and a pair of flexion/extension limiting joints attached to either side of said central opening, each one of said pair of flexion/extension limiting joints connecting a respective one of said pair of arms to said shoulder protector, whereby a wearer's cervical spine is protected from excessive flexion, extension, torsion, and compression.

14. The helmet and shoulder harness assembly of claim 13, wherein the helmet is constructed from high strength composite material and further comprises a cushion on the inside surface of said helmet.

15. The helmet and shoulder harness assembly of claim 14, wherein the helmet further comprises a cushion on the outer surface of said helmet.

16. The helmet and shoulder harness assembly of claim 15, wherein said shoulder harness is constructed from lightweight, high strength composite material and further comprises:

padding attached to the underside of said shoulder harness; and a pair of straps attached to either side of said shoulder harness for securing said shoulder harness to the wearer's shoulders.

17. The helmet and shoulder harness assembly of claim 16, wherein said bases are provided with ball bearings on said bottom surface.

18. The helmet and shoulder harness assembly of claim 17, wherein said flexion/extension limiting joint comprises:

a receptacle having a through hole therein for receiving a fastener;

said receptacle defining a cavity having an inner peripheral wall, wherein said wall is defined by a first arcuate surface, a second arcuate surface, and a pair of radially extending surfaces therebetween;

an insert inserted within said receptacle, said insert having a round receiving hole for mating with said through hole of said receptacle and for receiving said fastener;

a pair of contact surfaces extending radially from the central longitudinal axis of said hole;

said surfaces extend from a first arcuate surface to a second, larger arcuate surface forming an arc therebetween; wherein, said arcuate surfaces of said insert are concentric with said arcuate surface of said receptacle; whereby, upon rotation of said insert within said receptacle said contact surface of said insert abuts said radial surface of said receptacle, thereby limiting the flexion and extension of the wearer's neck.

* * * * *